US012053136B2

(12) United States Patent
Cole

(10) Patent No.: US 12,053,136 B2
(45) Date of Patent: Aug. 6, 2024

(54) VACUUM CLEANING APPLIANCE

(71) Applicant: Dyson Technology Limited, Wiltshire (GB)

(72) Inventor: Samuel Steven Cole, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 116 days.

(21) Appl. No.: 17/796,515

(22) PCT Filed: Dec. 7, 2020

(86) PCT No.: PCT/GB2020/053136
§ 371 (c)(1),
(2) Date: Jul. 29, 2022

(87) PCT Pub. No.: WO2021/156590
PCT Pub. Date: Aug. 12, 2021

(65) Prior Publication Data

US 2023/0346175 A1 Nov. 2, 2023

(30) Foreign Application Priority Data

Feb. 7, 2020 (GB) ..... 2001695

(51) Int. Cl.
*A47L 5/24* (2006.01)
*A47L 9/12* (2006.01)
(Continued)

(52) U.S. Cl.
CPC ..... *A47L 5/24* (2013.01); *A47L 9/127* (2013.01); *A47L 9/1666* (2013.01);
(Continued)

(58) Field of Classification Search
CPC ..... A47L 9/127; A47L 9/1666; A47L 9/322; A47L 9/2857; A47L 9/1658; A47L 9/28; A47L 9/2884; A47L 5/24
(Continued)

(56) References Cited

U.S. PATENT DOCUMENTS 1,916,006 A 6/1933 Leathers
2,046,172 A 6/1936 Leathers
(Continued)

FOREIGN PATENT DOCUMENTS

CN 103169420 A 6/2013
CN 104511887 B 11/2016
(Continued)

OTHER PUBLICATIONS

DE-102012211248-A1 espacenet (Year: 2024).*
(Continued)

*Primary Examiner* — Brian D Keller
*Assistant Examiner* — Tim Brady
(74) *Attorney, Agent, or Firm* — Tucker Ellis LLP

(57) ABSTRACT

A vacuum cleaning appliance includes a body having a longitudinal axis, and a motor unit located in the body for creating an airflow through the appliance. A handle extending along the longitudinal axis has a first end connected to the body and a free, second end. A filter assembly is detachably connected to the body proximate to the first end of the handle. The filter assembly defines a bore running through the filter assembly along the longitudinal axis, the bore being shaped to allow the filter assembly to slide along the handle towards the second end thereof following detachment from the body.

14 Claims, 8 Drawing Sheets

(51) Int. Cl.

| | |
|---|---|
| ***A47L 9/16*** | (2006.01) |
| ***A47L 9/28*** | (2006.01) |
| ***A47L 9/32*** | (2006.01) |

(52) U.S. Cl.
CPC ..... *A47L 9/2857* (2013.01); *A47L 9/2884* (2013.01); *A47L 9/322* (2013.01)

(58) Field of Classification Search
USPC ..... 15/344
See application file for complete search history.

(56) References Cited

U.S. PATENT DOCUMENTS

| | | | | |
|---|---|---|---|---|
| 2,083,914 | A | 6/1937 | Leathers | |
| 2006/0156508 | A1* | 7/2006 | Khalil | A47L 9/1666 15/353 |
| 2018/0008110 | A1 | 1/2018 | Peace | |
| 2018/0333021 | A1 | 11/2018 | Bohlen et al. | |
| 2019/0183306 | A1 | 6/2019 | King et al. | |
| 2019/0282049 | A1 | 9/2019 | Conrad et al. | |
| 2019/0282052 | A1 | 9/2019 | Conrad et al. | |

FOREIGN PATENT DOCUMENTS

| | | | | | |
|---|---|---|---|---|---|
| CN | 206934033 | U | | 1/2018 | |
| CN | 108463151 | A | | 8/2018 | |
| CN | 209122069 | U | * | 7/2019 | A47L 5/24 |
| CN | 110537873 | A | * | 12/2019 | A47L 9/20 |
| CN | 110537873 | A | | 12/2019 | |
| DE | 102012211248 | A1 | * | 1/2014 | A47L 5/225 |
| DE | 102012211248 | A1 | | 1/2014 | |
| GB | 2569870 | A | | 7/2019 | |
| JP | 2003-204903 | A | | 7/2003 | |
| WO | 2014/001502 | A1 | | 1/2014 | |
| WO | 2021/036039 | A1 | | 3/2021 | |

OTHER PUBLICATIONS

CN-209122069-U espacenet (Year: 2024).*
CN-110537873-A espacenet (Year: 2024).*
International Search Report and Written Opinion received for PCT Patent Application No. PCT/GB2020/053136, mailed on Mar. 9, 2021, 9 pages.
Search Report for GB Patent Application No. 2001695.2, Issued on Jul. 7, 2020, 1 page.
Office Action received for Chinese Patent Application No. 202080095263.9, mailed on Feb. 16, 2023, 17 pages (10 pages of English Translation and 7 pages of Original Document).

* cited by examiner

VACUUM CLEANING APPLIANCE

CROSS-REFERENCE TO PRIOR APPLICATION

This application is a § 371 National Stage Application of PCT International Application No. PCT/GB2020/053136 filed Dec. 7, 2020, which claims the priority of United Kingdom Application No. 2001695.2, filed Feb. 7, 2020, each of which are herein incorporated by reference in their entirety.

FIELD OF THE INVENTION

The present invention relates to a vacuum cleaning appliance. In its preferred embodiment, the present invention relates to a handheld vacuum cleaning appliance.

BACKGROUND OF THE INVENTION

A vacuum cleaner typically comprises a main body containing dirt and dust separating apparatus, a cleaner head connected to the main body and having an opening, and a motor unit for drawing dirt-bearing air through the opening and the cleaner head, and into the main body. The opening is directed downwardly to face the floor surface to be cleaned. The dirt-bearing air is conveyed to the separating apparatus so that dirt and dust can be separated from the air before the air is expelled to the atmosphere. The separating apparatus can include one or more of a filter, a filter bag and a cyclonic arrangement.

A handheld vacuum cleaner includes a handle which is generally located to one side of the separating apparatus and a trigger mounted on the handle to allow the user to activate the motor unit using the hand gripping the handle. A battery for supplying energy to the motor unit is generally located beneath the handle. The motor unit may be located above the handle, or it may be located above the separating apparatus.

SUMMARY OF THE INVENTION

In a first aspect, the present invention provides a vacuum cleaning appliance comprising a body having a longitudinal axis, a motor unit located in the body for creating an airflow through the appliance, a handle having a first end connected to the body and a free, second end, the handle extending along the longitudinal axis, and a filter assembly detachably connected to the body proximate to the first end of the handle, the filter assembly defining a bore running through the filter assembly along the longitudinal axis, the bore being shaped to allow the filter assembly to slide along the handle towards the second end thereof following detachment from the body.

This can allow the filter assembly to be detached from a compact vacuum cleaning appliance, having a handle which is co-axial with the body, through simply sliding the detached filter assembly along the handle and over the free end of the handle. No other disassembly of any other parts or sub-assemblies of the appliance is required. The filter assembly can be washed or replaced prior to reattachment to the body of the appliance.

When connected to the body, the filter assembly may be spaced from the handle along the longitudinal axis. Alternatively, when connected to the body, at least part of the filter assembly may extend about the handle, preferably about at least the first end of the handle.

The handle preferably comprises a user-operable power switch for actuating the motor unit. The switch is preferably located adjacent to the first end of the handle. This can allow the user to easily switch the appliance on and off, for example, using a thumb of a hand which is gripping the handle. A second switch may be located adjacent the power switch to allow the user to change an operating parameter of the appliance, for example the speed of the motor unit.

The appliance preferably comprises a battery pack for supplying energy to the motor unit. The battery pack is preferably located in the handle. The battery pack is preferably removably located in the handle to allow an exhausted battery pack to be exchanged for a charged battery pack during a cleaning process. Part of the battery pack preferably protrudes from the second end of the handle to allow the user to remove the battery pack through grasping the protruding portion of the battery pack and pulling the battery pack from the handle. The battery pack may be charged whilst situated within the handle. The handle preferably comprises a charging port for receiving a detachable charger for supplying energy to a circuit for charging the battery pack. The charging port is preferably located opposite to the power switch. The circuit is preferably located in the handle.

The handle thus also provides a housing for the battery pack, and so in a second aspect, the present invention provides a vacuum cleaning appliance comprising a body having a longitudinal axis, a motor unit located in the body for creating an airflow through the appliance, a battery pack for supplying energy to the motor unit, the battery pack being located within a housing having a first end connected to the body and a free, second end, the housing extending along the longitudinal axis, and a filter assembly detachably connected to the body proximate to the first end of the housing, the filter assembly defining a bore running through the filter assembly along the longitudinal axis, the bore being shaped to allow the filter assembly to slide along the housing towards the second end thereof following detachment from the body.

The motor unit preferably comprises an impeller and a motor for driving rotation of the impeller. The impeller is preferably mounted on a shaft which extends along the longitudinal axis of the body. The motor unit is preferably oriented so that the impeller is located closer to the first end of the handle than the motor. The motor unit is preferably located in a motor housing. The motor housing is preferably cylindrical in shape, and comprises a cylindrical side wall comprising a first set of apertures through which the airflow enters the motor casing upstream of the motor unit, and a second set of apertures through which the airflow leaves the motor casing downstream of the motor unit. The second set of apertures is positioned closer to the first end of the handle than the first set of apertures.

The filter assembly is preferably annular in shape. The bore is preferably circular in cross-section orthogonal to the longitudinal axis. The handle may have the same cross-section as the bore of the filter assembly. In a preferred embodiment, the handle and the bore have different cross-sections; the bore has a circular cross-section whilst the handle has a non-circular cross-section to facilitate gripping by the user. The handle have a cross-section in the shape of a rounded rectangle or square.

An external casing of the filter assembly preferably comprises an air outlet of the appliance. The air outlet preferably extends at least partially about the longitudinal axis, and is preferably arranged to emit the airflow in a direction perpendicular to the longitudinal axis, and so away from a hand which is gripping the handle of the appliance.

The filter assembly preferably comprises a filter located downstream from the motor unit, referred to hereafter as a post-motor filter, for removing dust from air exhausted by the motor unit. The post-motor filter is preferably annular in shape and extends about the longitudinal axis of the body. The post-motor filter may surround at least part of the impeller.

The filter assembly preferably further comprises a filter located upstream from the motor unit, referred to hereafter as a pre-motor filter, for removing dust from air entering the motor unit. The pre-motor filter is preferably cylindrical in shape. The pre-motor filter preferably surrounds the motor of the motor unit. The post-motor filter is preferably spaced from the pre-motor filter along the longitudinal axis of the body. The post-motor filter is preferably located closer to the first end of the handle than the pre-motor filter.

Each of the pre-motor filter and the post-motor filter is preferably connected to the casing of the filter assembly so that, as the filter assembly is detached from the body of the appliance, the casing, the pre-motor filter and the post-motor filter are detached as a single unit.

The appliance may further comprise acoustic foam for reducing sound levels emitted from the appliance, and in particular sound generated by the motor unit, during use of the appliance. The acoustic foam is preferably located in a housing of the motor unit. The acoustic foam is preferably located at the end of the housing which is proximate to the handle.

The appliance preferably comprises separating apparatus located upstream from the filter assembly for removing dust from an airflow drawn into the appliance by the motor unit. The separating apparatus preferably comprises a primary separation system, which is preferably in the form of a cyclonic separation system. The primary separation system is preferably defined by a cylindrical outer wall which is connected to the body so that the outer wall of the primary separation system is located on an opposite side of the body to the handle. The outer wall defines a separating chamber preferably having a longitudinal axis which is collinear with the longitudinal axis of the body. The axis of the cyclone flow within the primary separation system is thus preferably collinear with the longitudinal axis of the body.

The separating apparatus preferably further comprises a secondary separation system located downstream from the primary separation system, and upstream from the filter assembly. The secondary separation system preferably comprises a plurality of cyclones arranged in parallel and about the longitudinal axis of the body. The secondary separation system is preferably spaced along the longitudinal axis from the motor unit.

The appliance preferably comprises an air inlet through which the airflow generated by the motor unit enters the appliance. The air inlet is preferably located in a base which is connected to, and preferably moveable relative to, the outer wall of the primary separation system to allow the separation apparatus to be emptied. An inlet duct conveys the airflow from the air inlet to the separation apparatus. The inlet duct is preferably aligned parallel to, and more preferably along, the longitudinal axis of the body.

In its preferred embodiment, the appliance thus provides an "in line" arrangement, in which the air inlet, inlet duct, separating apparatus, filter assembly, motor unit, air outlet, handle and battery pack are all either located on, or extend about, the longitudinal axis of the body.

In a third aspect the present invention provides a vacuum cleaning appliance comprising a body having a longitudinal axis, a motor unit located in the body for creating an airflow through the appliance, the motor unit comprising an impeller mounted on a shaft having a rotational axis which is collinear with the longitudinal axis of the body, and a motor for rotating the shaft, a handle having a first end connected to the body and a free, second end, the handle extending along the longitudinal axis, a battery pack located within the handle, separating apparatus for separating dust from the airflow, the separating apparatus comprising a primary cyclonic separating system which generates an airflow about the longitudinal axis, and a secondary cyclonic separating system comprising a plurality of cyclones arranged in parallel about the longitudinal axis, and a filter assembly comprising a first filter arranged upstream of the motor unit for separating dust from the airflow exhausted from the separating apparatus, and a second filter arranged downstream from the motor unit for separating dust from the airflow exhausted from the motor unit, each of the first filter and the second filter extending about the longitudinal axis.

Features described above in connection with the first aspect of the invention are equally applicable to the second and third aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
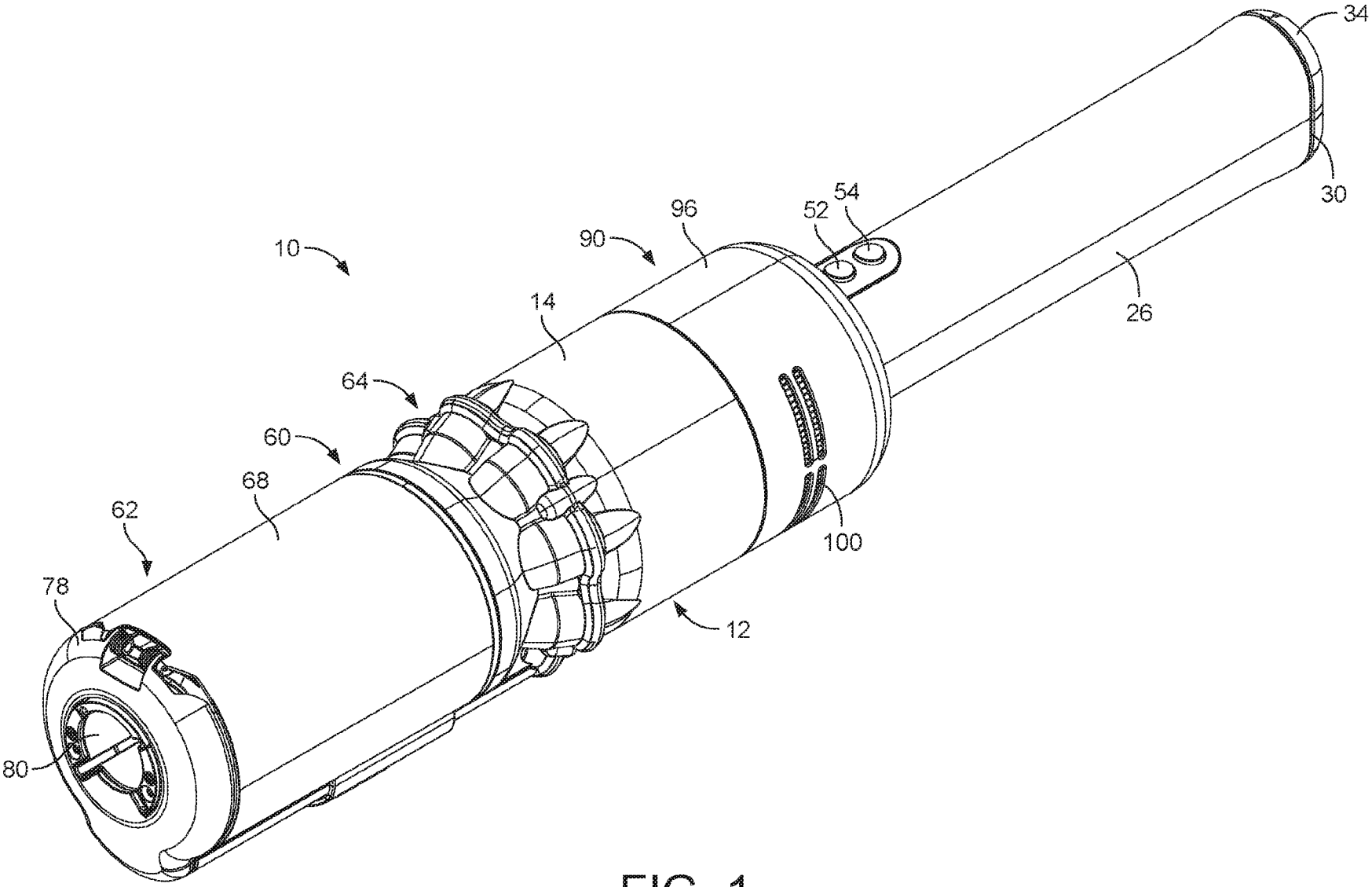
FIG. 1 is a front perspective view of a vacuum cleaning appliance.
Figure 2:
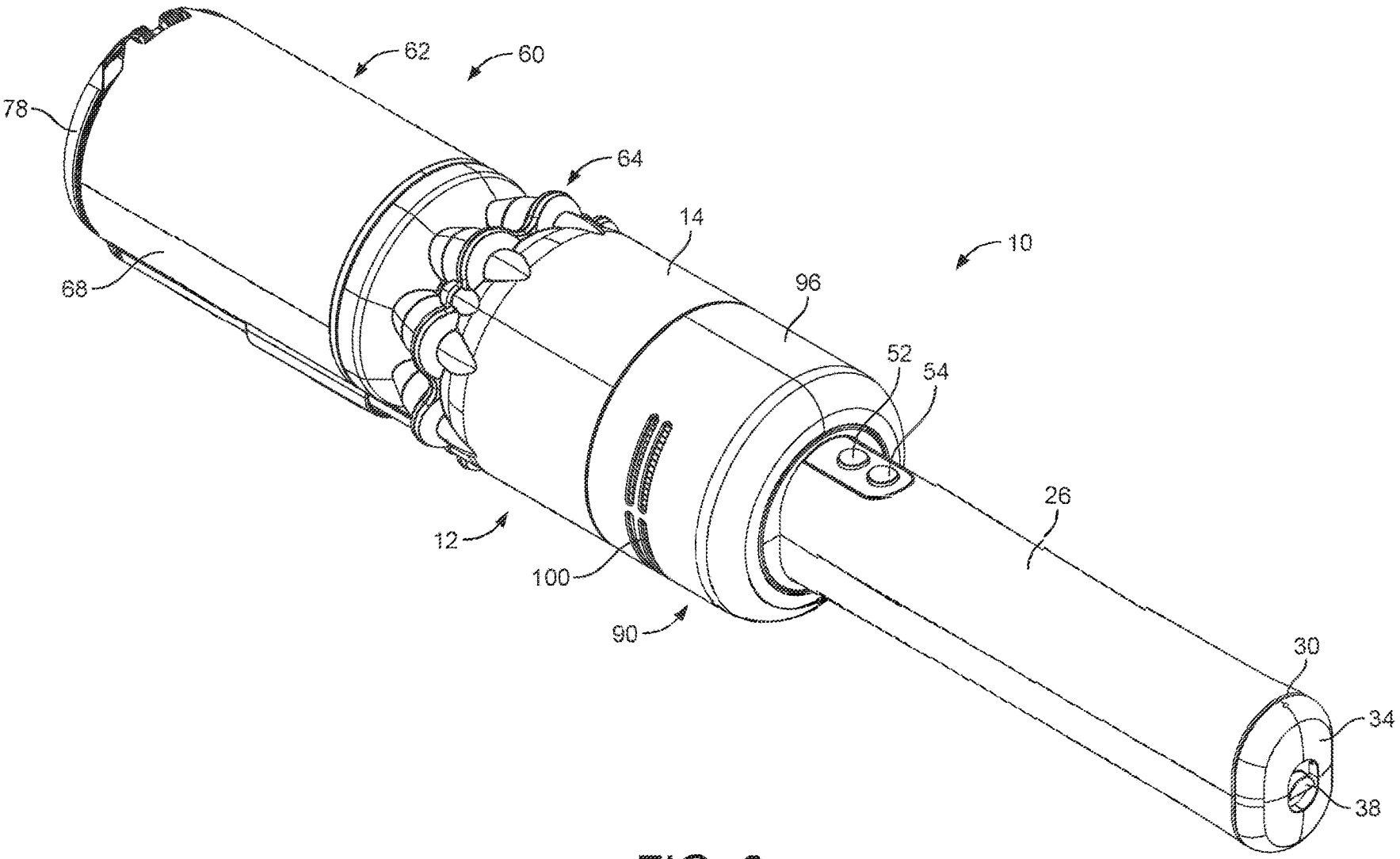
FIG. 2 is a rear perspective view of the appliance.
Figure 3:
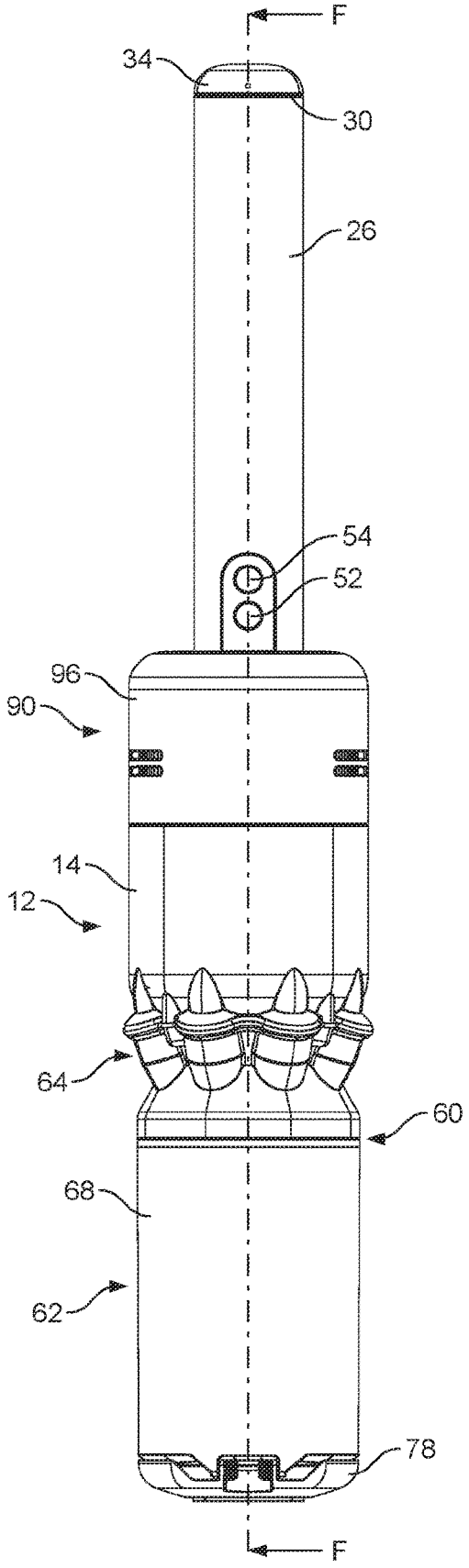
FIG. 3 is a top view of the appliance.

FIGS. 1 to 4 illustrate a vacuum cleaning appliance 10. The appliance 10 comprises a main body 12 having an external casing 14. The main body 12 has a central longitudinal axis X. The main body 12 houses a motor unit 16 for creating an airflow through the appliance 10. The motor unit 16 is located within a motor housing 18, and comprises an impeller 20 mounted on a shaft 22 which is aligned along the longitudinal axis X, and a motor 24 for rotating the shaft 22, and thus the impeller 20, about the longitudinal axis X.

A handle 26 is connected to one side of the main body 12. The handle 26 has a first end 28 connected to the main body 12, and a free second end 30 remote from the main body 12. The handle 26 is elongate in shape, and preferably extends along the longitudinal axis X away from the main body 12. The length of the handle 26 is selected to enable a user to grip the appliance 10 using a single hand. Along its length, the handle 26 has a generally uniform cross-section perpendicular, and preferably has a non-circular cross-section for promoting user comfort whilst gripping the handle 26. In this embodiment, the handle 26 has a cross-section which is generally in the shape of a rounded rectangle.

Figure 5:
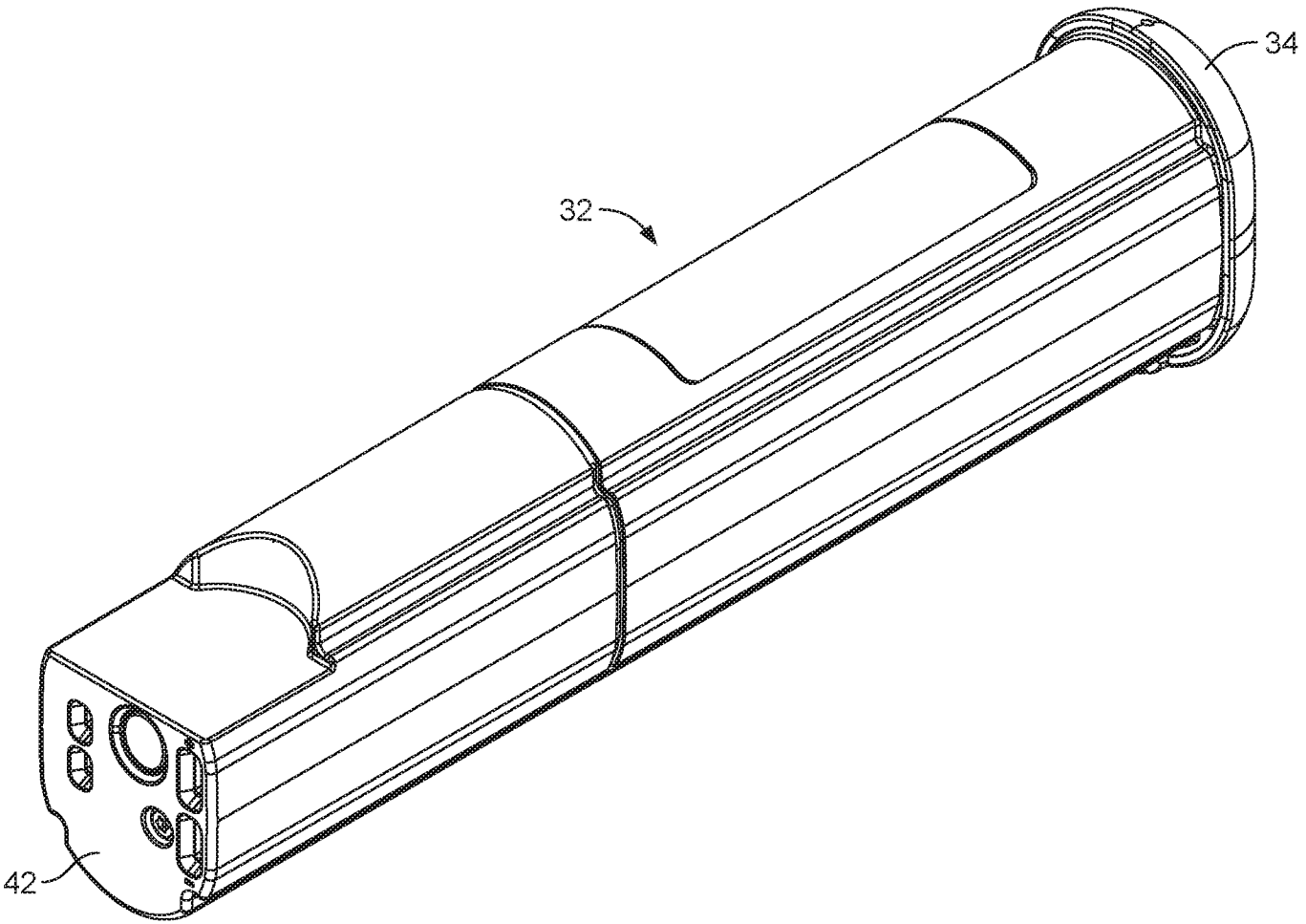
FIG. 5 is a front perspective view of a filter assembly of the appliance.

With reference also to FIG. 5, the handle 26 provides a housing for a battery pack 32 for supplying electrical energy to the motor unit 16. The battery pack 32 preferably comprises a plurality of batteries 33, in this embodiment four batteries 33. The battery pack 32 is removably located in the handle 26. A first end 34 of the battery pack 32 protrudes from the second end 30 of the handle 26 to allow the battery pack 32 to be gripped by the user for removal from the handle 26. A finger-actuable catch mechanism 36 is housed within the first end 34 of the battery pack 32 for releasably retaining the battery pack 32 within the handle 26. To release the battery pack 32, the user slides an actuator 38 of the catch mechanism against the biasing force of a spring to move a catch away from a retaining wall of the handle 32, and then pulls the battery pack 32 out from the handle 26. The battery pack 32 may be replaced by a charged battery pack 32, or subsequent to its own charging, by inserting the charged battery pack 32 into the handle 26 through the open second end 30 until the catch mechanism 36 engages the handle 26 to retain the battery pack 32 within the handle 26.

Terminals located at the second end 42 of the battery pack 32 connect the batteries 33 to a control circuit 44 located in the handle 26. The control circuit 44 is connected by a cable 46 to a motor circuit 48 mounted on the motor unit 16. The motor circuit 48 is located on the end of the motor unit 16 which is remote from the handle 26, and actuates the motor 18 of the motor unit 16 in response to signals received from the control circuit 44. The control circuit 44 is connected to a charging port 50 located on the lower side of the handle 26 to allow the battery pack 32 to be connected to a source of electrical power for recharging the batteries 33 of the battery pack. Switches 52, 54 are mounted on the upper side of the handle 26 to enable a user to control the operation of the motor unit 16 to draw an airflow into the appliance 10. In this embodiment, a first switch 52 is used to actuate (on/off) the motor unit 16, and a second switch 54 is used to control the speed of rotation of the impeller 20 (high/low) to vary the rate of airflow through the appliance 10.

A separating apparatus 60 for separating dust, dirt and other detritus from the airflow is connected to the main body 12 opposite to the handle 26. The separating apparatus comprising a primary separation system 62 and a secondary separation system 64. In this embodiment, the primary separation system 62 comprises a cyclonic separation system comprising a separating chamber 66 which is defined by a cylindrical outer wall 68. The separating chamber 66 has a longitudinal axis which is collinear with the longitudinal axis X of the main body 12. Inside the separating chamber 66 is a shroud 70 which is in the form of a cylindrical screen, and shroud skirt 72 which acts to effectively separate the separating chamber 66 into two portions—a separation portion around the shroud 70 within which airflow can swirl about the longitudinal axis X, and a dirt collection portion below the shroud 70 where dirt separated in the separation portion can collect prior to being emptied.

The secondary separation system 64 is located between the primary separation system 62 and the main body 12. The secondary separation system 64 preferably also comprises a cyclonic separation system. In this embodiment the secondary separation system 64 comprises a plurality of cyclone bodies 74 arranged about the longitudinal axis X, and a fine dust collection chamber 76 for collecting dust separated by the cyclone bodies 74. The fine dust collection chamber 76 extends through the separating chamber 66. The separating chamber 66 and the fine dust collection chamber 76 are open at one end, and are closed by way of a base 78 that is hingedly connected to the outer wall 68. The base 78 is pivotable between a closed position in which the separating chamber 66 and the fine dust collection chamber 76 are sealed to contain any dirt and dust inside them, and an open position in which the ends of the separating chamber 66 and the fine dust collection chamber 76 are open, and dirt and dust can be removed or ejected. A central portion of the base 78 comprises an aperture which defines an air inlet 80 of the appliance 10. A duct 82 passing through the separating chamber 66 along the longitudinal axis X conveys an airflow drawn into the appliance 10 through the air inlet 80 to the primary separation system 62.

A cleaning tool may be connected to the air inlet 80 of the appliance 10. Alternatively, one end of an elongate wand may be connected to the air inlet 80, and a cleaning tool may be connected to the other end of the wand.

Figure 6:
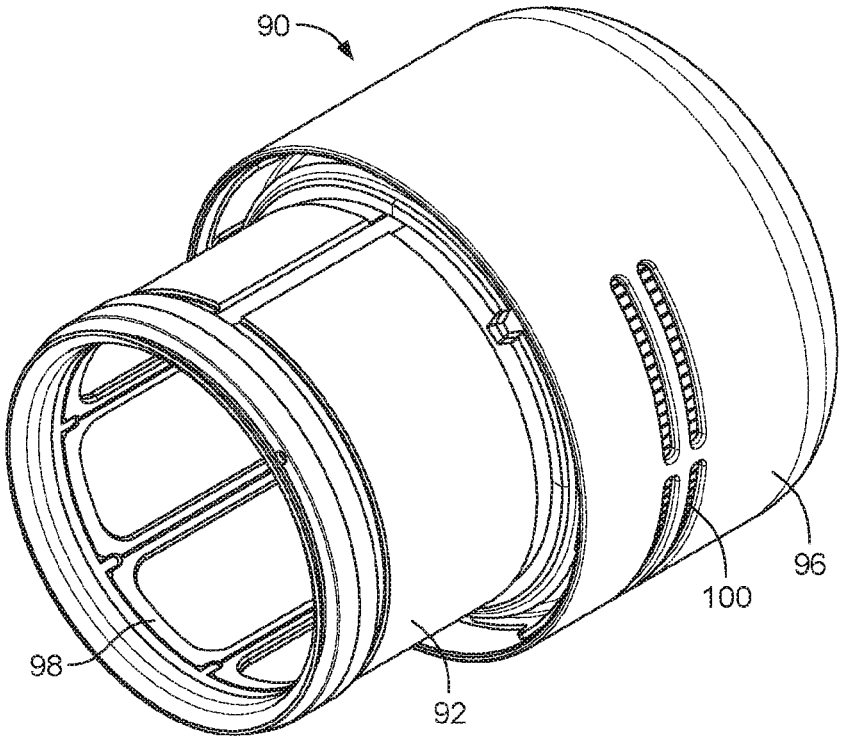
FIG. 6 is an end view of the filter assembly.
Figure 7:
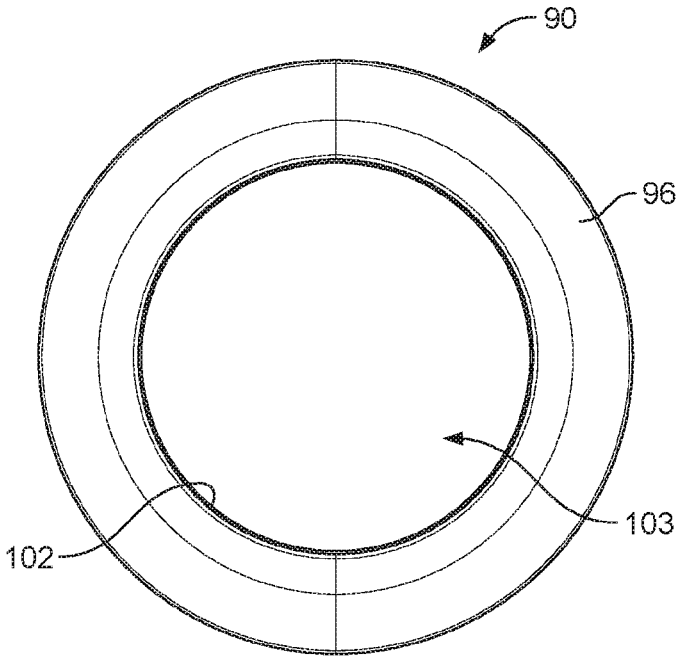
FIG. 7 is a front perspective view of a battery pack of the appliance.

The appliance 10 further comprises a filter assembly 90 for removing dust from the airflow. With reference also to FIGS. 6 and 7, in overview the filter assembly 90 comprises a first filter, hereafter referred to as a pre-motor filter 92, which is located downstream from the separating apparatus 60 and upstream from the motor unit 16, for removing dust from the airflow before it enters the motor unit. The filter assembly 90 further comprises a second filter, hereafter referred to as a post-motor filter 94, which is located downstream from the motor unit 16, for removing dust from the airflow before it is exhausted into the external atmosphere. The pre-motor filter 92 and the post-motor filter 94 are both connected to a filter casing 96 which is detachably connected to the main body 12 of the appliance 10. The pre-motor filter 92 and the post-motor filter 94 are both annular in shape, and both surround the longitudinal axis X. The pre-motor filter 92 is positioned adjacent the post-motor filter 94 to minimise the overall size of the filter assembly 90.

The pre-motor filter 92 can be formed of any suitable filter material, or combination of materials, typically found in pre-motor filters. In the present embodiment the pre-motor filter 92 comprises layers of filter media including a layer of scrim or web material, a non-woven filter medium such as fleece, followed by a further layer of scrim or web material. An electrostatic filter medium could also be included if desired. The post-motor filter 94 can similarly be formed of any suitable filter material, or combination of materials, typically found in post-motor filters. In the present embodiment, the post-motor filter 94 is formed of a pleated HEPA-standard (high efficiency particulate air) filter medium.

Figure 4:
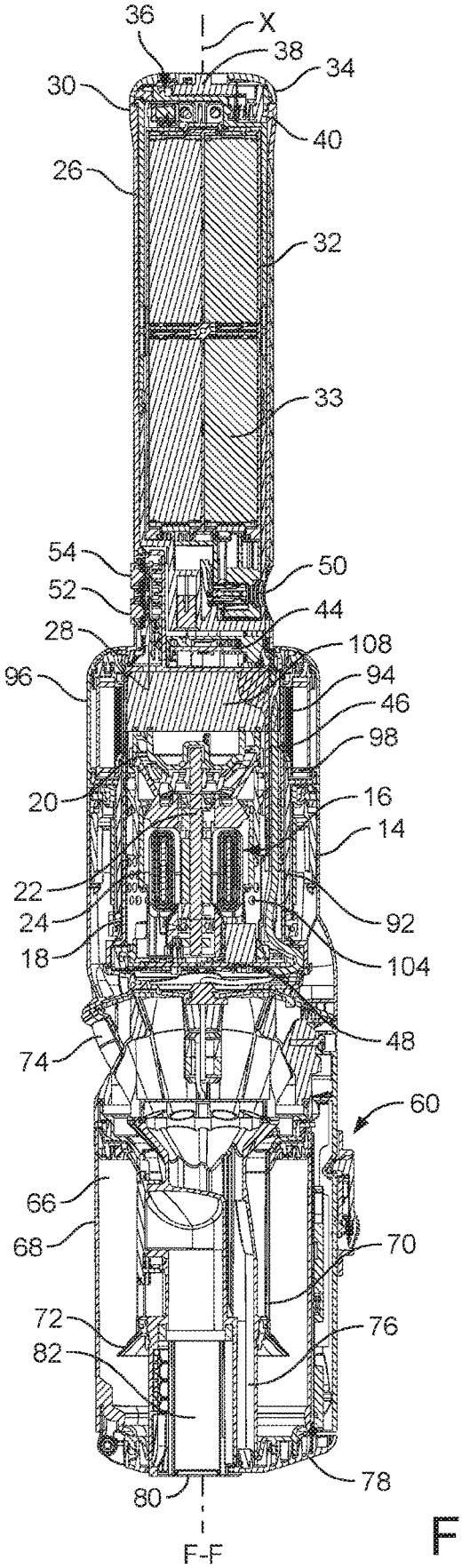
FIG. 4 is a side sectional view taken along line F-F in FIG. 3.

With particular reference to FIGS. 4 and 6, the filter assembly 90 comprises a frame 98 which extends from the filter casing 96. The pre-motor filter 92 is positioned around the frame 98, which acts to support the pre-motor filter 92 so that it maintains its annular shape during use. The post-motor filter 94 is fixed inside the filter casing 96. An annular seal 98 positioned inside the filter assembly 90 between the pre-motor filter 92 and the post-motor filter 94 serves to isolate the airflow passing through the pre-motor filter 92 from the airflow passing through the post-motor filter 94. The filter casing 96 has a number of vent holes 100, or apertures, which provide an air outlet of the appliance. In FIG. 1, the post-motor filter 94 is partially visible through the vent holes 100.

The filter casing 96 is generally annular in shape and comprises a central aperture 102 which is centred on the longitudinal axis X. The filter assembly 90 thus comprises a bore 103 which extends through the filter assembly 90, and about which the pre-motor filter 92 and the post-motor filter 94 extend.

As illustrated in FIG. 4, when the filter assembly 90 is connected to the main body 12, the handle 26 protrudes outwardly from the bore 103 of the filter assembly 90. The motor housing 18 comprises a side wall containing a first plurality of through-holes 104 defining an inlet through which air enters the motor housing 18, and a second plurality of through-holes 106, spaced from the first plurality of through-holes 104, defining an outlet through which air leaves the motor housing 18. The side wall is preferably generally cylindrical in shape. An inlet of the motor unit 16 is aligned with the first set of through-holes 104, and an outlet of the motor unit 16 is aligned with the second set of through-holes 106. A cavity located between the motor unit 16 and the end of the motor housing 18 can house, for example, an open cell acoustic foam 108 in order to provide acoustic dampening benefits. With the filter assembly 90 connected to the main body 12, the pre-motor filter 92 is positioned around the first set of through-holes 104, and the post-motor filter 94 positioned around the second set of through-holes 106.

During operation of the appliance 10, when the switch 52 is depressed the motor unit 16 is activated by the control circuit 44 to generate an airflow through the appliance 10. Dirt-laden air is drawn into the appliance 10 through the air inlet 80. The dirt-laden air passes along the duct 82 and enters the separating chamber 66, which creates a swirling airflow about the shroud 70. Larger dirt and debris is removed from the air due to centrifugal forces as the air swirls around separating chamber 66. The air passes through the shroud 70 and enters the secondary separation stage 64. The cyclone bodies 74 separate finer dust from the airflow, which falls into the fine dust collection chamber 76. The relatively clean air leaves the secondary separation stage 64 and passes radially inwardly through the pre-motor filter 92 and the first set of through-holes 104 in turn to enter the motor housing 18. The airflow passes upwardly (as shown in FIG. 4) through the motor housing 18 and subsequently passes radially outwardly through the second set of through-holes 106 and the post-motor filter 94 before being emitted radially outwardly from the vent holes 100 in the filter casing 96 into the atmosphere.

Figure 8:
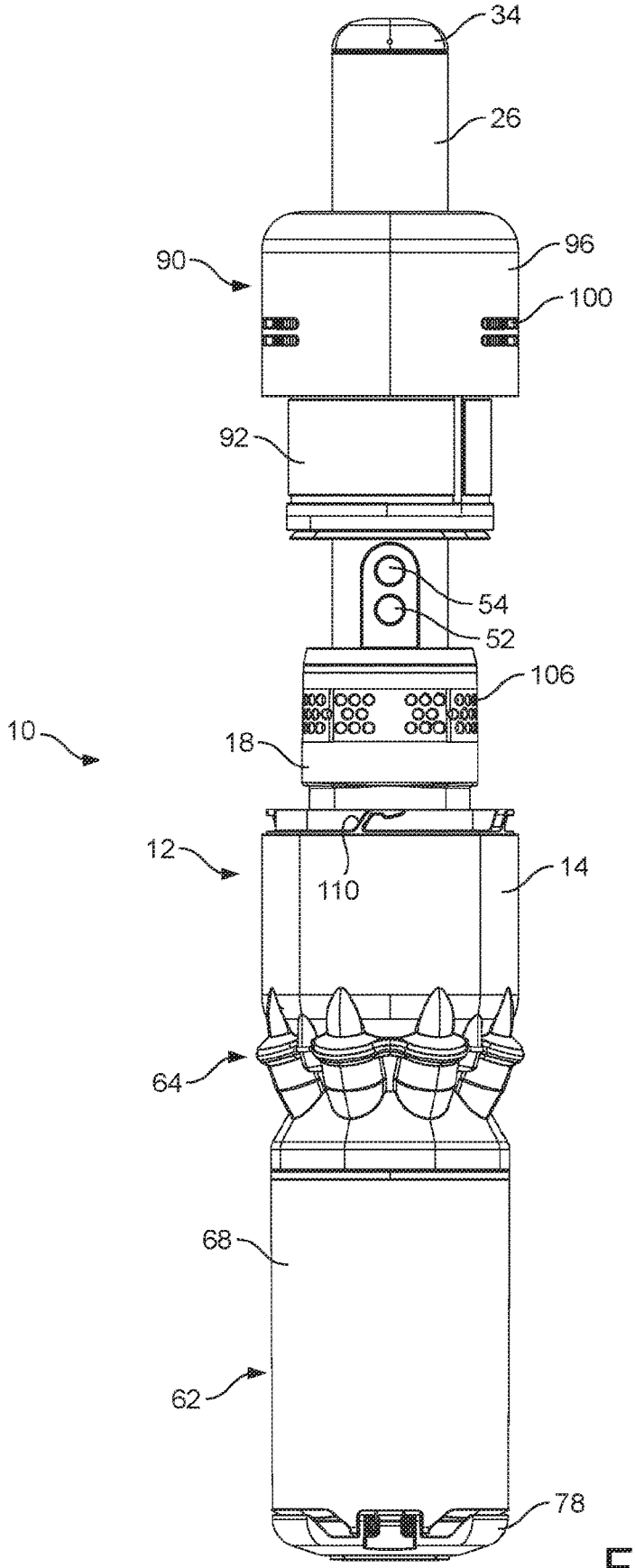
FIG. 8 is a similar view to FIG. 3, but with the filter assembly located part way along the handle of the appliance.
Figure 9:
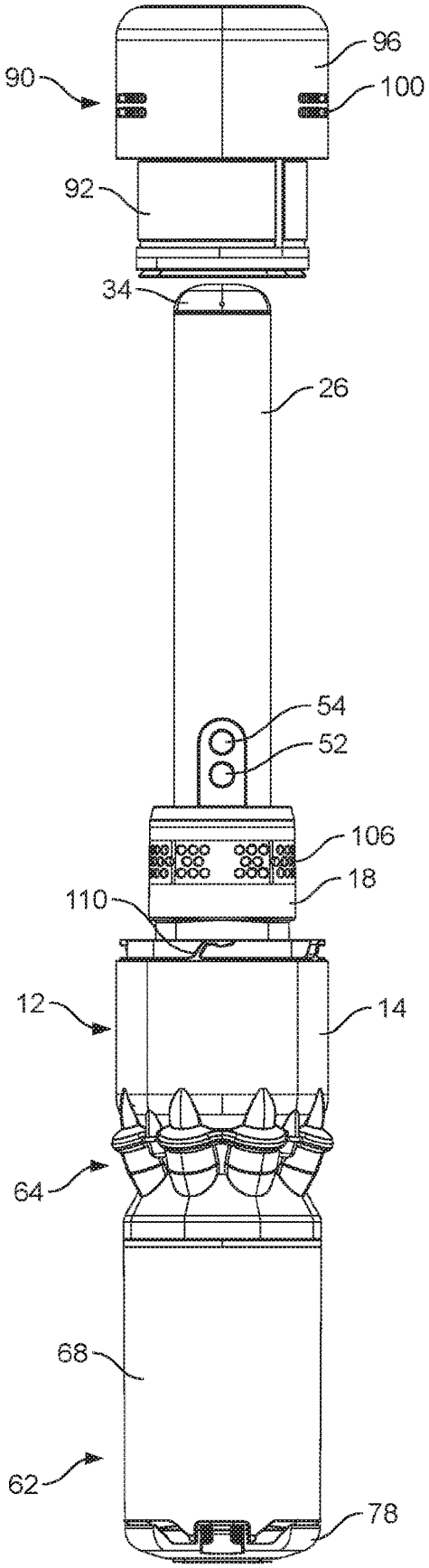
FIG. 9 is a similar view to FIG. 8, but with the filter assembly fully separated from the remainder of the appliance.

As mentioned above, the filter assembly 90 is detachably connected to the main body 12. The removal and/or replacement of the filter assembly 90 is illustrated in FIGS. 8 and 9. The external casing 14 of the main body 12 comprises a catch 110, or other temporary fixing means, for locking the filter assembly 90 in place while the appliance is in use. There is a corresponding engagement member on the filter casing 96 of the filter assembly 90 which engages with the catch 110 on the main body 12. Rotation of the filter assembly 90 is required to engage the engagement member with the catch 110. Alternative temporary fixing means could be used instead of the catch 110. For example, the filter assembly 90 could be retained on the appliance 10 by way of a magnetic engagement.

To remove the filter assembly 90 from the appliance 10, the user grips the main body 12 of the appliance 10 with one hand and, with the other hand, grasps the filter casing 96 and rotates the filter casing 96 relative to the main body 12 to disengage the engagement member on the filter casing 96 from the catch 110 on the main body 12. The user then slides the filter assembly 90 along the handle 26 and subsequently over the second end of the handle 26. The filter assembly 90 may then be cleaned by the user before reattachment to the main body 12. To replace the filter assembly 90, the user simply reverses the above process; the filter assembly 90 is positioned over the second end 30 of the handle 26 and slid over the handle 26 towards the main body 12. Whilst pushing the filter assembly 90 against the main body 12, the user rotates the filter assembly 90 relative to the main body 12 so that the engagement member on the filter casing 96 engages the catch 110 on the main body 12 to retain the filter assembly 90 on the main body 12.

The invention claimed is:

1. A vacuum cleaning appliance comprising:

a body having a longitudinal axis;

a motor unit located in the body, the motor unit being operable to create an airflow through the appliance;

a handle having a first end connected to the body and a free, second end, the handle extending along the longitudinal axis; and a filter assembly detachably connected to the body proximate to the first end of the handle, wherein the filter assembly defines a bore running through the filter assembly, wherein the bore is shaped to allow the filter assembly, following detachment of the filter assembly from the body, to separate from the body and slide along the handle to the second end of the handle.

2. The appliance according to claim 1, wherein the filter assembly is annular in shape.

3. The appliance according to claim 1, wherein, when connected to the body, at least part of the filter assembly extends about the handle.

4. The appliance according to claim 1, wherein, when connected to the body, at least part of the filter assembly extends about the motor unit.

5. The appliance according to claim 1, further comprising a battery pack housed by the handle, the battery pack being operable to supply energy to the motor unit.

6. The appliance according to claim 5, wherein the battery pack is removable from the handle.

7. The appliance according to claim 6, wherein the battery pack is removable through the second end of the handle.

8. The appliance according to claim 5, wherein part of the battery pack protrudes from the second end of the handle.

9. The appliance according to claim 1, further comprising a user-operable power switch mounted on the handle.

10. The appliance according to claim 9, wherein the power switch is located adjacent the first end of the handle.

11. The appliance according to claim 1, wherein an external casing of the filter assembly comprises an air outlet of the appliance.

12. The appliance according to claim 11, wherein the air outlet extends at least partially about the longitudinal axis.

13. The appliance according to claim 11, wherein the air outlet is arranged to emit the airflow in a direction perpendicular to the longitudinal axis.

14. The appliance according to claim 1, wherein:

the bore and handle are shaped to allow the filter assembly, following the detachment of the filter assembly from the body, to separate from the body and slide along the handle and beyond the second end of the handle for removal of the filter assembly from the handle of the vacuum cleaning appliance.

* * * * *